US007084825B2

(12) United States Patent
Sakae et al.

(10) Patent No.: US 7,084,825 B2
(45) Date of Patent: Aug. 1, 2006

(54) ANTENNA AND ELECTRONIC DEVICE USING THE SAME

(75) Inventors: Misako Sakae, Hirakata (JP); Naoki Yuda, Hirakata (JP); Yuki Satoh, Osaka (JP); Tsutomu Inuzuka, Hirakata (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 10/515,965

(22) PCT Filed: Dec. 22, 2003

(86) PCT No.: PCT/JP03/16425

§ 371 (c)(1),
(2), (4) Date: Nov. 23, 2004

(87) PCT Pub. No.: WO2004/064193

PCT Pub. Date: Jul. 29, 2004

(65) Prior Publication Data

US 2005/0156805 A1 Jul. 21, 2005

(30) Foreign Application Priority Data

Jan. 10, 2003 (JP) ..... 2003-004449

(51) Int. Cl.
*H01Q 7/08* (2006.01)

(52) U.S. Cl. ..... 343/788; 343/895; 343/782

(58) Field of Classification Search ..... 343/895, 343/787, 788, 872

See application file for complete search history.

(56) References Cited

U.S. PATENT DOCUMENTS

| | | | | |
|---|---|---|---|---|
| 4,270,128 | A * | 5/1981 | Drewett | 343/702 |
| 5,923,305 | A * | 7/1999 | Sadler et al. | 343/895 |
| 6,388,625 | B1 * | 5/2002 | Fukushima et al. | 343/702 |
| 6,661,391 | B1 * | 12/2003 | Ohara et al. | 343/895 |
| 6,822,620 | B1 * | 11/2004 | Watada et al. | 343/895 |
| 2004/0198428 | A1 * | 10/2004 | Hong et al. | 455/556.1 |

FOREIGN PATENT DOCUMENTS

| | | | |
|---|---|---|---|
| EP | 0-984-510 | A | 3/2000 |
| EP | 1-098-387 | A | 5/2001 |
| JP | 2001-196845 | A | 7/2001 |
| JP | 2002-118490 | A | 4/2002 |
| WO | WO 99/48169 | A1 | 9/1999 |
| WO | WO 02/055315 | A1 | 7/2002 |

* cited by examiner

*Primary Examiner*—Hoanganh Le
*Assistant Examiner*—Ephrem Alemu
(74) *Attorney, Agent, or Firm*—RatnerPrestia

(57) ABSTRACT

An antenna capable of attaining the miniaturization thereof and the widening of a band in use, and an electronic device containing this antenna therein, having a miniaturized structure and adaptable to a wide band. This antenna is provided with a feeding element having a feeder end, an antenna core provided with the feeding element on an outer circumference thereof, a feeder lead connected to the feeder end, and a magnetic member covering the feeder end. This electronic device is provided with the antenna, a transmission system, and a reception system, and the feeder lead of the antenna is connected to at least one of the transmission system and reception system.

9 Claims, 4 Drawing Sheets

ANTENNA AND ELECTRONIC DEVICE USING THE SAME

This application is a U.S. National Phase Application of PCT International Application PCT/JP2003/016425 filed Dec. 12, 2003, which claims priority of Japanese patent application No. 2003-004449; filed Jan. 10, 2003.

TECHNICAL FIELD

This invention relates to an antenna and an electronic device using the same.

BACKGROUND ART

FIG. 6 shows the construction of a related art antenna. The related art antenna is provided with one end-opened feeding element 101, antenna core 100 on an outer circumference of which this feeding element 101 is provided, and feeder lead 102 connected to feeder end of this feeding element 101. Feeding element 101 is connected to a feeder portion on a printed board via feeder lead 102. In this structure, a resonance frequency in λ/4 mode resonance is controlled by adjusting the length of feeding element 101, and an radio wave is radiated owing to its resonance current. The λ/4 mode resonance referred to above occurs in a resonance mode in which the level of a current becomes highest in the feeder portion of feeding element 101, and lowest in the opened end of feeding element 101 most distant from the feeder portion with a voltage becoming highest.

The above-described related art antenna is disclosed in, for example, WO99/48169.

In this kind of antenna, a dielectric is used for antenna core 100, and the wavelength of an electromagnetic field is thereby reduced, the miniaturization of the antenna being thus attained.

In general, in order to reduce a required length of feeding element 101, a λ/4 mode resonance in which substantially ¼ of a wavelength λ in the frequency in use is satisfactory is mainly used.

In the λ/4 mode resonance, the antenna can be expressed equivalently by a parallel resonance circuit of a capacitor and an inductor. When this λ/4 mode resonance is subjected to the shortening of wavelength by using a dielectric, a value of the capacitor equivalently increases (capacitiveness increases), and the frequency characteristics of impedance becomes steep. As a result, a usable band becomes narrow.

DISCLOSURE OF THE INVENTION

An antenna is provided with:

a feeding element opened at one end thereof and having a feeder end at the other end thereof, an antenna core having the feeding element on an outer circumference thereof, a feeder lead connected to the feeder end, and a magnetic member covering an outer circumferential portion of the feeder end.

The electronic device is provided with:

the above-mentioned antenna, a transmission system adapted to execute signal processing for the transmission of a signal, and a reception system adapted to execute signal processing for the reception of a signal, a feeder lead of the antenna being connected to at least one of the transmission system and reception system.

DETAILED DESCRIPTION OF THE PREFERRED EMBODIMENTS

An object of the present invention is to secure the miniaturization of an antenna, and widen a band in use.

The embodiments of the present invention will be described.

Figure 1:
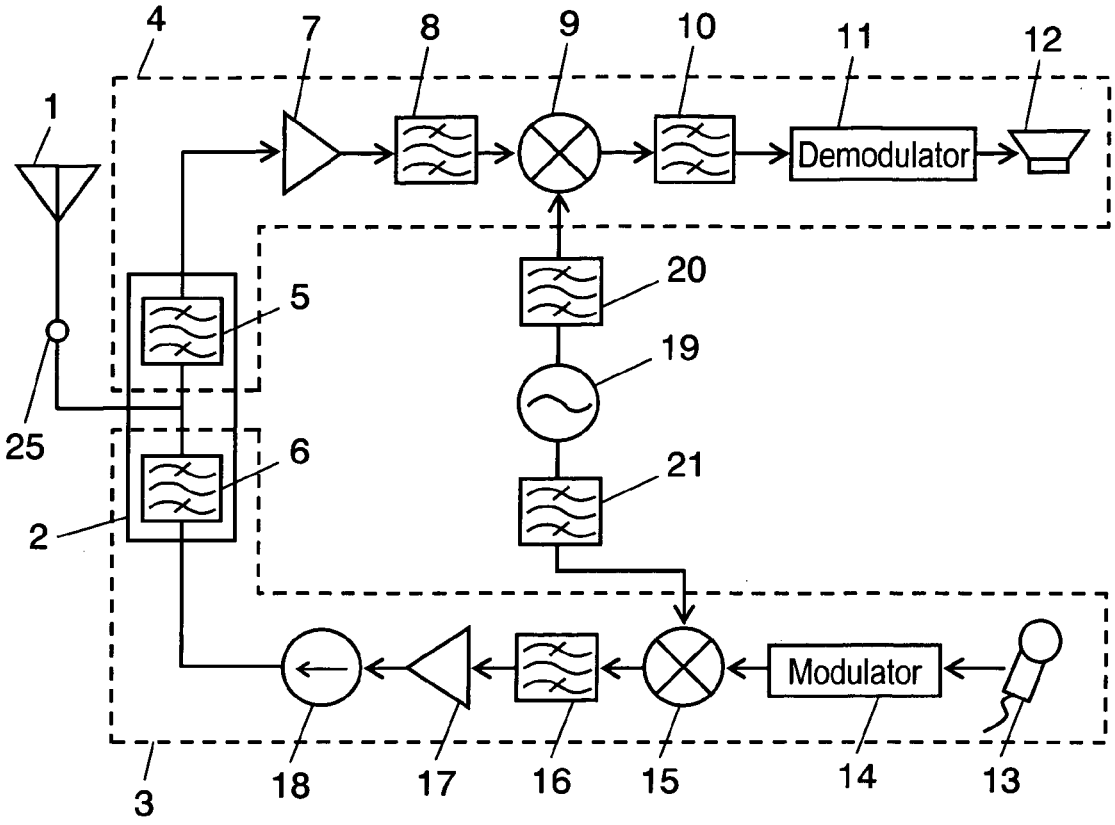
FIG. 1 is a block circuit diagram of a portable telephone using the antenna according to the present invention.

FIG. 1 is a block circuit diagram of a portable telephone mounted with the antenna according to the present invention. Referring to FIG. 1, antenna 1 is connected to duplexer 2 via feeder terminal 25. This duplexer 2 includes transmission filter 6 and reception filter 5. An input terminal of reception filter 5 and an output terminal of transmission filter 6 are all connected to feeder terminal 25. An output terminal of reception filter 5 is connected to amplifier 7, while an input terminal of transmission filter 6 is connected to isolator 18. Antenna 1 receives an radio wave, which is transfered as an electric signal to reception filter 5 of duplexer 2. Reception filter 5, amplifier 7, inter-stage filter 8, mixer 9, IF filter (intermediate frequency filter) 10, demodulator 11 and loud speaker 12 are connected together in series, and these members constitute reception system 4. Reception system 4 selects a signal in a desired frequency band from reception radio wave, and this signal is then subjected to amplification, frequency conversion, demodulation and restoration to a voice signal. Loud speaker 12 outputs a voice obtained by subjecting the reception radio wave to restoration.

The voice inputted into microphone 13 is converted into an electric signal, which is fed to modulator 14. Microphone 13, mixer 15, inter-stage filter 16, amplifier 17, isolator 18 and transmission filter 6 are connected together in series, and these members constitute the transmission system 3. Transmission system 3 converts a voice into an electric signal, subjects the resultant signal to modulation, frequency-conversion and amplification, and passes therethrough only a signal component in a frequency band that is to be transmitted. Thus, a high-frequency signal in a predetermined frequency band is transmitted as an radio wave from antenna 1 via feeder terminal 25.

Voltage control oscillator (VCO) 19 is connected to the mixer 9 and mixer 15 via local oscillation filter 20 and local oscillation filter 21 respectively. Voltage control oscillator (VCO) 19 controls a transmission frequency thereof by a frequency control voltage. This frequency control voltage is generated correspondingly to a frequency of a signal to be transmitted and received via antenna 1. Mixer 9 subjects a high-frequency signal inputted from the inter-stage filter 8 thereinto to frequency conversion by using a local oscillation signal inputted via the local oscillation filter 20 thereinto. In the meantime, mixer 15 subjects a signal inputted from modulator 14 thereinto to frequency conversion by using a local oscillation signal inputted thereinto via local oscillation filter 21.

Figure 2A:
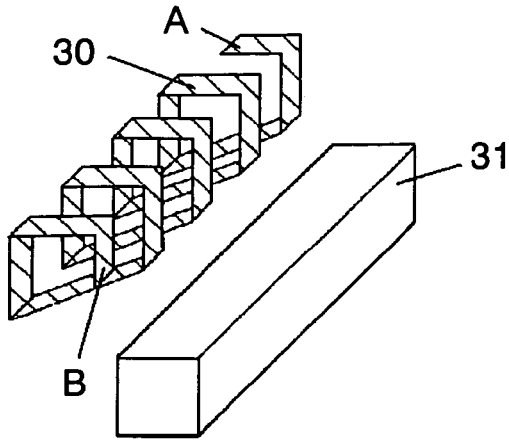
FIG. 2A is an exploded view in perspective showing a part of the antenna in a mode of embodiment of the present invention.
Figure 2B:
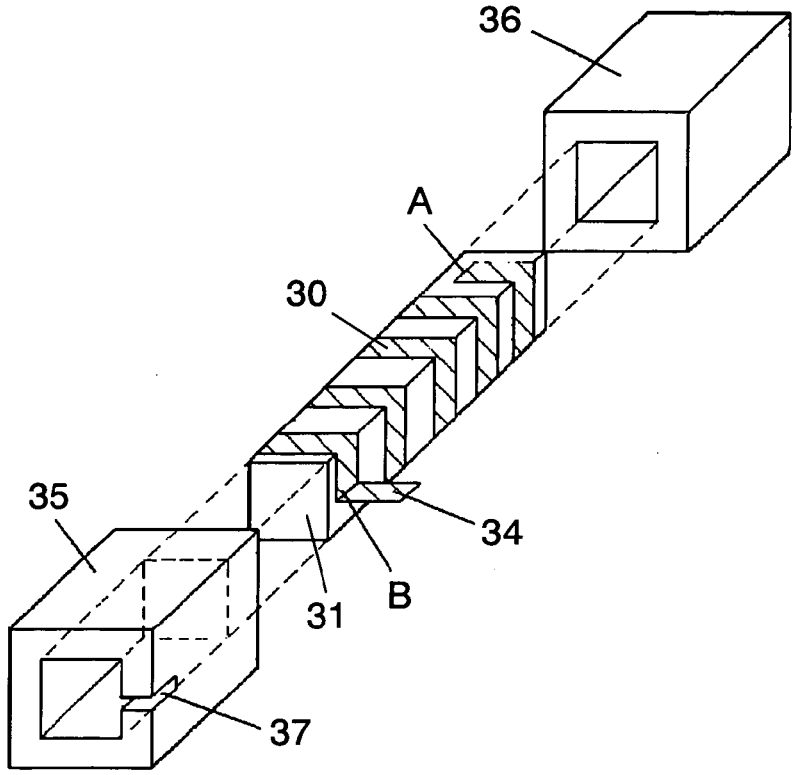
FIG. 2B is an exploded view in perspective showing the mode of embodiment of the present invention.
Figure 2C:
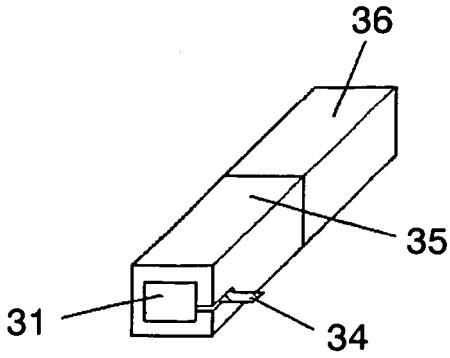
FIG. 2C is an assembly drawing showing the mode of embodiment of the present invention.

Antenna 1 shown in FIG. 1 will now be described with reference to FIGS. 2A to 2C as well. FIG. 2A to FIG. 2C show the construction of the antenna according to the present invention. As shown in FIG. 2A to FIG. 2C, antenna 1 includes feeding element 30, antenna core 31, feeder lead 34, magnetic member 35 and spacer 36. Antenna 1 according to the present invention can also be formed even when the spacer 36 is not used. Feeding element 30 is formed by helically winding a copper wire, copper foil and the like, and has opened end A at one end thereof, and feeder end B at the other end thereof. Antenna core 31 is made of an insulating member, and has a rectangular solid body. Feeding element 30 is provided on an outer circumferential portion of antenna core 31. Antenna core 31 is formed as of a resin, for example, ABS, phenol, polycarbonate or the like.

As shown in FIG. 2B, feeder end B of feeding element 30 is electrically connected to feeder lead 34 by soldering. Feeding element 30 fundamentally works as an antenna. A current is fed to feeding element 30 via feeder lead 34, and antenna 1 can function as a $\lambda/4$ mode resonance antenna by adjusting the width and length of a conductor constituting feeding element 30.

Around feeder end side B of feeding element 30 of antenna core 31 thus formed, hollow rectangular solid type magnetic member 35 is provided as an externally fitted state. Draw-out recess 37 is formed at an end portion of magnetic member 35, and feeder lead 34 is drawn out therefrom.

Spacer 36 is provided around a side of opened end A of feeding element 30. Spacer 36 has a hollow rectangular solid body just as magnetic member 35, and is inserted into antenna core 31. Spacer 36 is formed of an insulating material of a resin, for example, ABS, phenol, polycarbonate or the like. Magnetic member 35 is formed of, for example, a ferrite-based material or the like.

FIG. 2C is a sketch drawing of the antenna according to the present invention formed as described above.

The most characteristic point of this mode of embodiment shown in FIG. 2A to FIG. 2C reside in the provision of magnetic member 35 on a side of feeder end B of feeding element 30, and the provision of spacer 36 of an insulating material made of a resin constituting a nonmagnetic material on a side of the opened end A of feeding element 30.

When antenna core 31 is wholly covered with a magnetic member, inductivity of inductance value equivalently increases. This enables a band in use to be widened owing to the moderation of the frequency characteristics of impedance, and a wide-band antenna to be obtained.

The magnetic material generally has the characteristics of a dielectric as well. The matter will therefore be discussed from a viewpoint of losses to be made. When a dielectric is used, only a dielectric loss is made. However, the use of a magnetic material makes ill effects, i.e., a band in use decreases due to the dielectric characteristics thereof and the radiation efficiency lowers due to a dielectric loss and a magnetic loss.

Therefore, in the structure according to the present invention, magnetic member 35 is provided around feeder end B, i.e., around feeder lead 34. The ill effects mentioned above can be avoided by providing magnetic member 35 in this manner. In addition, a region around feeder end B, i.e. a region around feeder lead 34 is a region in which a loop of a standing-wave current exists, and in which a magnetic field occurring due to the antenna becomes largest. Therefore, providing magnetic member 35 around feeder end B (i.e., around feeder lead 34) contributes most effectively to the shortening of the antenna. It is also possible to moderate frequency variation of impedance by increasing the inductivity of the magnetic member, and widen the band in use. Moreover, spacer 36 of an insulating material made of a resin constituting a nonmagnetic material is provided in a position in which the current concentration on the side of opened end A is low. Namely, spacer 36 is provided in a region in which a node of a standing-wave current exists. When spacer 36 is thus provided, the spacer does not substantially have dielectric characteristics and magnetic characteristics, and this enables the occurrence of a dielectric loss and a magnetic loss to be held down.

When nonmagnetic spacer 36 is thus provided, the occurrence of a magnetic loss can be held down, and a decrease in the radiation efficiency can be prevented.

When an insulating material substantially not having dielectric characteristics is used as spacer 36, the occurrence of a dielectric loss can further be held down, and a decrease in the radiation efficiency can be more effectively prevented.

When the structure according to the present invention is thus employed, a miniaturized antenna having wide-band characteristics can be provided.

An electronic device employing the antenna in the mode of embodiment shown in FIG. 2A to FIG. 2C will now be described with reference to FIG. 3 as well.

Figure 3:
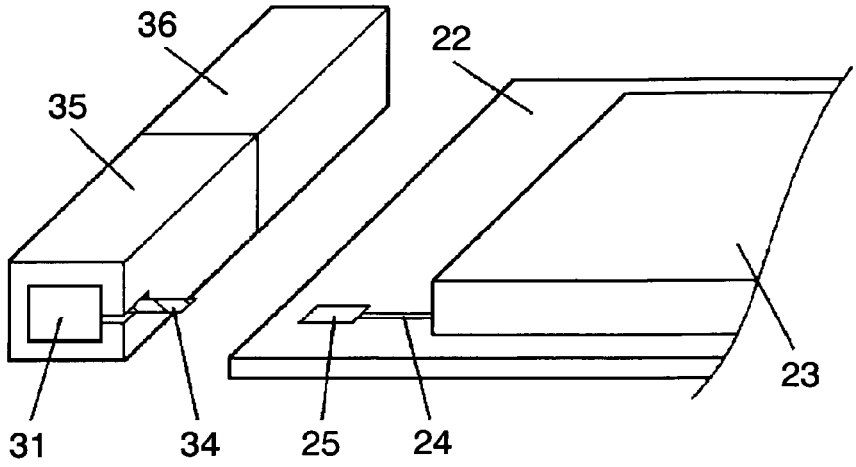
FIG. 3 is a perspective view showing a principal portion of an electronic device in the condition in which the antenna according to the present invention is incorporated therein.

FIG. 3 is a perspective view showing a principal portion of an electronic device employing this antenna 1.

Referring to FIG. 3, printed board 22 is mounted with transmission and reception circuit unit 23. The transmission and reception circuit unit 23 includes at least such reception system 4 and transmission system 3 as are shown in FIG. 1. An input terminal of reception filter 5 and an output terminal of transmission filter 6 in this transmission and reception circuit unit 23 are connected to feeder terminal 25 via signal line 24. This feeder terminal 25 is connected electrically by soldering to feeder lead 34 shown in FIG. 2B and FIG. 2C. Thus, an electronic device is formed. During this connecting operation, magnetic member 35 and spacer 36 are, of course, made to have the same outer shape and fixed stably to printed board 22.

Although antenna core 31 formed so as to have the shape of a rectangular solid was described, a columnar antenna core on an outer circumference of which feeding element 30 can be formed easily may also serve the purpose. Moreover, feeding element 30 can also be formed by subjecting antenna core 31 to plating and printing.

When antenna is formed in this manner, the miniaturization of an electronic device itself can be attained.

Another structure of the antenna according to the present invention will now be described with reference to FIG. 4.

Figure 4:
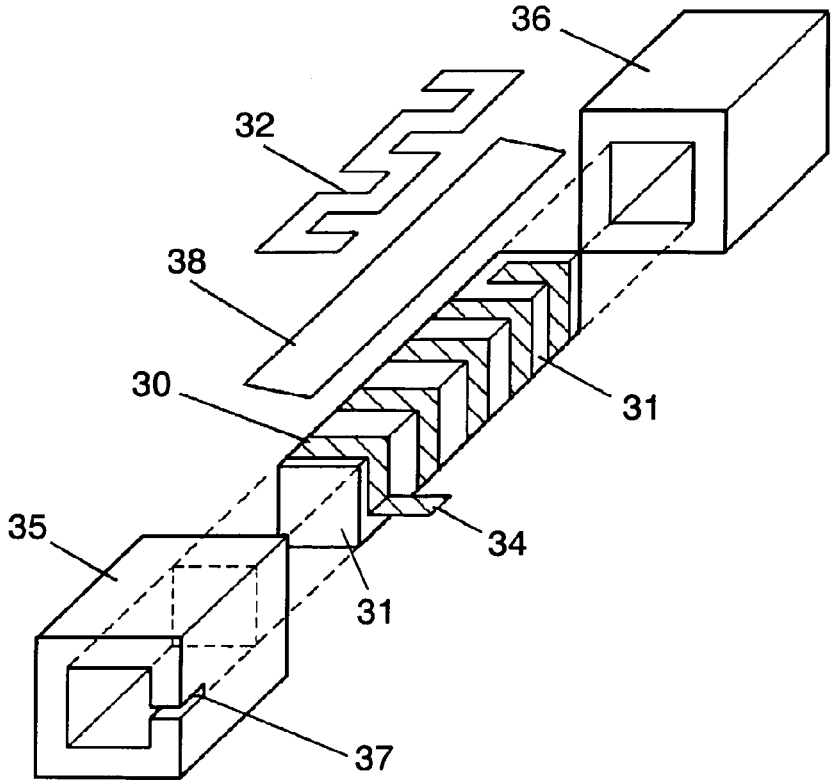
FIG. 4 is an exploded view in perspective of another mode of embodiment of the antenna according to the present invention.

An antenna shown in FIG. 4 is formed by providing in the same structure as is shown in FIG. 2 parasitic element 32 on feeding element 30 with an insulating member 38, which is made of an insulating sheet, inserted therebetween. Parasitic element 32 is different from feeding element 30, and not an element for inputting and outputting a high-frequency signal directly thereinto and therefrom. The parts the reference numerals of which are the same as those of the parts shown in FIG. 2 represent the same parts, and a detailed description of such parts will be omitted.

Since parasitic element 32 is provided independently of feeding element 30 with the insulating member 38 inserted therebetween, the electromagnetic field coupling occurs between the two elements. When this electromagnetic field coupling is utilized, two resonance frequencies can be obtained. In addition, the adjustment of the resonance frequencies can be carried out easily, so that a miniaturized two-frequency adaptable antenna can be practically obtained.

The mounting of the antenna shown in FIG. 4 can, of course, be done as well as the antenna shown in FIG. 3.

Still another structure of the antenna according to the present invention will now be described with reference to FIG. 5.

Figure 5:
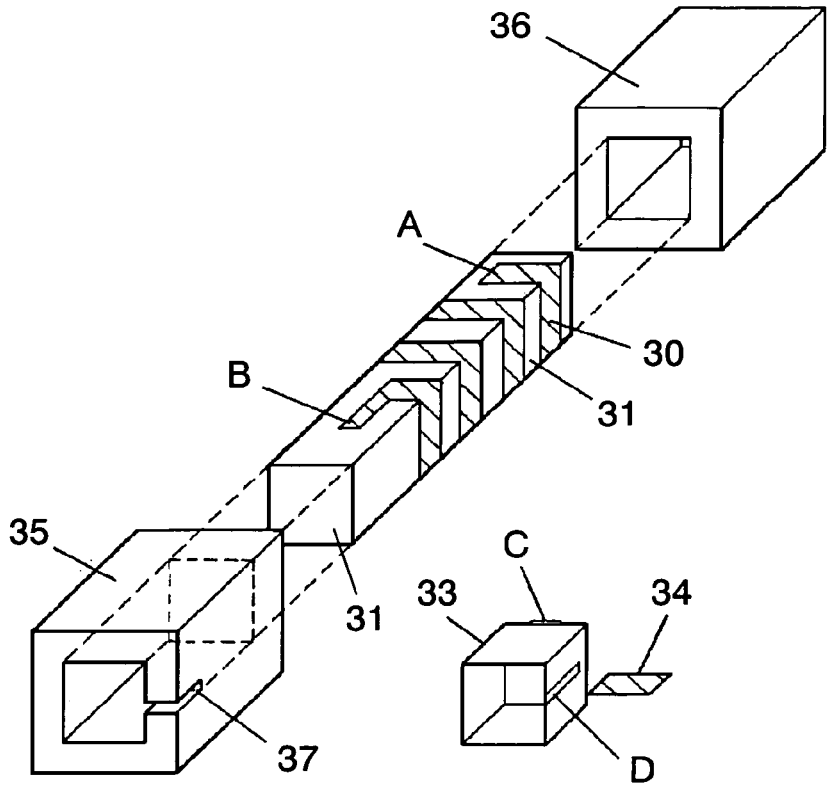
FIG. 5 is an exploded view in perspective of still another mode of embodiment of the antenna according to the present invention.
Figure 6:
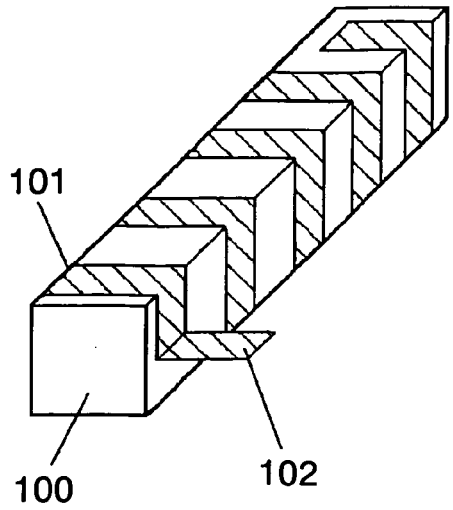
FIG. 6 is a perspective view of a related art antenna.

An antenna shown in FIG. 5 is provided with feeding element 30 on an outer circumferential surface of antenna core 31 in the same manner as the antenna shown in FIG. 2. Annular conductor 33 is further provided on antenna core 31. A position in which the conductor 33 is provided is on a side of a feeder end B of feeding element 30. The side of feeder end B and a C portion of the annular conductor 33 are connected together electrically by soldering. This annular conductor 33 is further connected at a D portion thereof to feeder lead 34 electrically by soldering. Magnetic member 35 and spacer 36 are then incorporated in the resultant structure to form an antenna. The parts, the reference numerals of which are the same as those in FIG. 2, represent the same parts, and a detailed description of these parts will be omitted.

Since the annular conductor 33 is provided on the feeder side, electromagnetic field coupling occurs between annular conductor 33 and feeding element 30. When this electromagnetic field coupling is utilized, the further widening of a band in use can be attained.

The mounting of the antenna shown in FIG. 5 can, of course, be done as well as the antenna shown in FIG. 3.

In the above embodiments, antenna core 31 is described as an antenna core formed of an insulating material. This antenna core 31 can also be formed of a dielectric or a magnetic material. When a dielectric or a magnetic material is used, a wavelength of the antenna can be reduced, so that the miniaturization of the antenna can further be done.

Antenna core 31 can also be formed of an insulating material at an opened end side thereof, and of a magnetic material at a feeder end side thereof. In this structure, an insulating material which does not substantially have dielectric characteristics and magnetic characteristics is used in a portion in the vicinity of the opened end in which a magnetic field is concentrated. This prevents a decrease in a band in use due to the dielectric characteristics, and the occurrence of a dielectric loss and a magnetic loss to be held down. Therefore, a decrease in the radiation efficiency can be prevented.

The above description says that microphone 13, mixer 15, inter-stage filter 16, amplifier 17, isolator 18 and transmission filter 6 are connected together in series to form the transmission system 3. However, transmission system 3 in the present invention is not limited to this structure. Transmission system 3 in the present invention indicates a circuit portion for executing the signal processing for the transmission of a signal.

As described above, in the antenna according to the present invention, a magnetic member is provided in a portion in the vicinity of a feeder end in which the current concentration occurs most in $\lambda/4$ mode resonance. Therefore, the effect of the magnetic member in reducing the wavelength of electromagnetic field and increasing the inductivity of the magnetic member can be effectively displayed. This enables the miniaturization of the antenna and the widening of a band in use to be attained.

As described above, the present invention can provide an antenna-contained, miniaturized electronic device.

INDUSTRIAL APPLICABILITY

The present invention can provide an antenna capable of attaining the miniaturization thereof and the widening of a band in use. Moreover, the present invention can provide an electronic device containing the antenna according to the present invention therein, having a small-sized structure and capable of being adapted to a wide band.

The invention claimed is:

1. An antenna comprising:

an antenna element having an antenna core and a feeding element opened at one end thereof and having a feeder end at the other end thereof, said feeding element helically wound about the antenna core;

a first cover which is magnetic and which covers an outer circumference of the feeding element at the other end of the feeding element;

a second cover which is non-magnetic and which covers the outer circumference of the feeding element at the one end; and a feeder lead connected to the feeder end.

2. An antenna according to claim 1, further comprising:

a parasitic element both ends of which are opened; and an insulator, wherein the parasitic element is provided on the feeding element with the insulator inserted therebetween.

3. An antenna according to claim 1, further comprising an annular conductor provided between the antenna element and the first cover, wherein the feeder end is connected to one end of the feeder lead via the annular conductor.

4. An antenna according to claim 1, wherein the first cover has a draw-out recess from which the feeder lead is drawn out.

5. An antenna according to claim 1, wherein the second cover is formed of an insulating resin.

6. An antenna according to claim 1, wherein the antenna core is formed of a dielectric or a magnetic material.

7. An antenna according to claim 6, wherein the antenna core is made of an insulating member at the side of the opened end thereof, and a magnetic member at the side of the feeder end thereof.

8. An electronic device comprising:

an antenna including:

an antenna element having an antenna core and a feeding element opened at one end thereof and having a feeder end at the other end thereof, said feeding element helically wound about the antenna core;

a first cover which is magnetic and which covers an outer circumference of the feeding element at the other end of the feeding element;

a second cover which is non-magnetic and which covers the outer circumference of the feeding element at the one end;

a feeder lead connected to the feeder end;

a transmission system for executing the signal processing for the transmission of a signal; and a reception system for executing the signal processing for the reception of a signal, wherein the feeder lead of the antenna is connected to at least one of the transmission system and reception system.

9. An electronic device according to claim 8, wherein said antenna is further comprising:

a parasitic element both ends of which are opened; and an insulator, wherein the parasitic element is provided on the feeding element with the insulator inserted therebetween.3

* * * * *

UNITED STATES PATENT AND TRADEMARK OFFICE

CERTIFICATE OF CORRECTION

PATENT NO. : 7,084,825 B2
APPLICATION NO. : 10/515965
DATED : August 1, 2006
INVENTOR(S) : Misako Sakae et al.

It is certified that error appears in the above-identified patent and that said Letters Patent is hereby corrected as shown below:

Column 8

At line 4, delete "3".

Signed and Sealed this

Second Day of January, 2007

JON W. DUDAS
*Director of the United States Patent and Trademark Office*